United States Patent [19]

Drees

[11] 4,185,178

[45] Jan. 22, 1980

[54] CONTROL COVER FOR POWER WINDOW OR POWER DOOR LOCK

[76] Inventor: Anthony J. Drees, 2420 Talcolt Rd., Park Ridge, Ill. 60068

[21] Appl. No.: 938,454

[22] Filed: Aug. 31, 1978

[51] Int. Cl.[2] ..... H01H 9/28; H01H 19/04

[52] U.S. Cl. ..... 200/42 T; 200/153 K; 200/333

[58] Field of Search ..... 200/42 T, 42 R, 44, 200/318, 304, 321, 339, 331, 153K, 333; 70/202, 204; 16/118, 121; 74/566; 292/DIG. 2

[56] References Cited

U.S. PATENT DOCUMENTS

| | | | |
|---|---|---|---|
| 1,871,605 | 8/1932 | Guett | 200/42 R |
| 2,169,860 | 8/1979 | Von Horn | 70/203 |
| 2,259,622 | 10/1941 | Despard | 200/42 T |
| 2,813,938 | 11/1954 | Speizman | 200/42 |
| 2,829,222 | 4/1958 | Dunham | 200/304 |
| 3,109,899 | 11/1963 | Pastene | 200/42 |
| 3,170,050 | 2/1965 | Buturuga | 200/42 |
| 3,681,556 | 8/1972 | Osika | 200/333 X |
| 3,778,577 | 12/1979 | Fromknecht | 200/333 X |

*Primary Examiner*—Frederick R. Schmidt
*Attorney, Agent, or Firm*—Dennison, Dennison, Meserole & Pollack

[57] ABSTRACT

A safety cover for the control unit of an automobile power window or power door lock including a knob positionable over the actuating lever of the control unit so as to enclose the lever and the surrounding opening through which the lever projects. The cover further includes, either as an integral part of the knob or as a separate attachment, a pair of laterally spaced rearwardly projecting bifurcated legs positionable to opposite sides of the actuating lever and adapted to snap-lock to the transverse shaft which mounts the lever.

8 Claims, 7 Drawing Figures

CONTROL COVER FOR POWER WINDOW OR POWER DOOR LOCK

BACKGROUND OF THE INVENTION

The present invention generally relates to safety or protective means for control switches, and is more specifically concerned with means for selectively preventing access to and manipulation of the control lever of a conventional automobile power window or power door lock.

Electrically driven power windows for automobiles, of late, have become increasingly more popular. Normally a control is provided for each window with the control consisting basically of a housing with a forward opening therein surrounded by an escutcheon. Internally of the housing will be mounted appropriate electrical contact elements controlled by a lever positioned within the housing and accessible through the forward opening thereof. The lever in turn normally pivotally mounts on a transverse shaft for a rocking action for selective raising and lowering of the associated window. Similar construced units are also provided so as to remotely control door locks.

While such levers are normally substantially flush with the escutcheon, or even slightly recessed relative thereto, accidental manipulation of the lever can occur, particularly where young children are involved. This in turn can result in a potentially hazardous situation, for example the trapping of a finger or arm arising from an unexpected closing of the window, or enabling the unintentional opening of a door.

The safety cover presented herein is specifically designed so as to provide a temporary cover or concealment means for the control lever or button of a power window or door lock. The cover will, with a limited degree of force, snap-lock over the control lever by direct engagement to the transverse shaft which mounts such lever. Removal of the cover will be slightly more difficult so as to prevent accidental disengagement or removal by a small child. This is achieved both through the configuration of the two bifurcated legs which engage the lever shaft, and through the provision of a generally tapered configuration to the cover knob. The knob also will preferably have an ornamental appearance complementing that of the interior of the vehicle.

Insofar as is known, no covers exist as proposed herein for making a power window or door lock control functionally inoperative or inaccessible. However, attention is directed to the following patents wherein safety guards for conventional light switches are disclosed.

| | | |
|---|---|---|
| BUTURUGA | 3,170,050 | February 16, 1965 |
| PASTENE | 3,109,899 | November 5, 1963 |
| SPEIZMAN | 2,813,938 | November 19, 1957 |
| VON HOORN | 2,169,860 | August 15, 1939 |

There is no teaching in any of these patents of the utilization of a cover with an automobile power window or door lock control. Nor is there any suggestion of a switch cover which snap-locks to a lever mounting shaft.

SUMMARY OF THE INVENTION

The safety cover comprising the invention includes an enlarged knob of a size so as to extend over and cover the control lever, and at the same time conceal the opening within which the lever operates. Mounting of the knob is effected by means of a pair of laterally spaced rearwardly extending flat spring material legs, the outer ends of which are bifurcated so as to engage over the lever mounting shaft to the opposite sides of the lever. Each bifurcated end includes an enlarged shaft conforming recess inward of the extreme end thereof whereby an actual snap-locking of the legs, and hence the cover, to the shaft is achieved. While the legs can be formed integrally with the knob, as a matter of manufacturing convenience, it is more likely that the legs will be defined by a U-shaped member, of spring metal or the like, which has the bight portion thereof received within an enlarged recess defined within the rear of the knob. Appropriate means, such as a rivet, can extend through the knob and the bight portion with the forward end or head of the rivet being concealed by an appropriate cover plate. The knob, along with the cover plate, can be of a generally ornamental appearance to complement the interior of the vehicle. Further, it is contemplated that the knob be so configured, as by the use of inclined upper and lower sides, so as to require some degree of manual dexterity and force to remove the cover, thereby preventing removal by the very young.

DESCRIPTION OF THE PREFERRED EMBODIMENT

Figure 1:
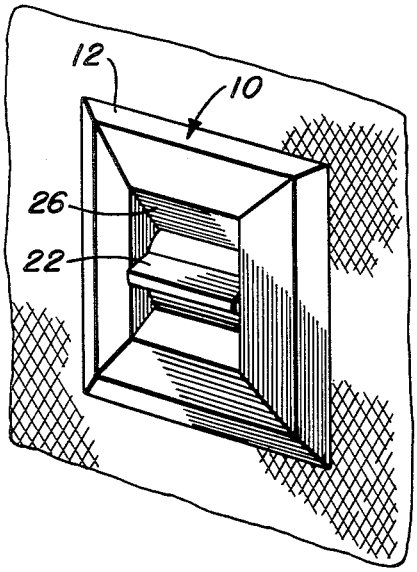
FIG. 1 is a perspective view of a conventional vehicle power window control mounted in operative position within a vehicle.

To facilitate describing the invention, and with reference to the drawings, one form of conventional power window control has been illustrated and designated by numeral 10. This power window control includes a front escutcheon plate or panel 12 and a rearwardly projecting central housing 14 either integrally formed with the escutcheon plate or separately formed and appropriately affixed thereto. The housing 14 will normally be received through an opening 16 defined in the interior paneling 18 of the vehicle where the control 10 is to be located. This paneling can actually constitute the interior door panel, the upper surface of an arm rest, the dash board, or any other location deemed appropriate for the control. The housing is fixed in position by any appropriate means such as retaining clips (not illustrated).

An appropriate electrical contact unit 20 is mounted within the housing 14 and projects rearwardly thereof. This control unit is activated in a conventional manner through a conventional actuating lever 22 pivotally mounted on a transverse shaft 24 affixed to the opposed sides of the housing. The lever 22, or at least the forwardly directed portion thereof exposed through an enlarged opening 26 centrally within the escutcheon 12 and the front of the housing 14, is in the nature of a flat rectangular button selectively pushed upward or downward for a like directional control of the window. The opposite end of the actuating switch 22 will normally be enlarged and rotatably received over the shaft 24. Finally, although not illustrated, appropriate resilient means is normally associated with the actuating lever to bias the lever to a neutral central position.

As an alternate arrangement, and depending upon the particular installation involved, the escutcheon 12 can be eliminated and the front of the housing set flush with the vehicle paneling in which it is mounted.

The above-described construction of power window controls is conventional and is detailed to clarify a specific environment of the invention. As will be appreciated, power door lock activators are quite similar in construction.

The power window or door lock control cover 28 of the invention is particularly adapted to overlie and enclose the actuating lever 22 so as to preclude access thereto. This cover 28, consists, in the illustrated embodiment, basically of two components, an enlarged forwardly directed knob or cover member 30 and a rearwardly directed U-shaped spring metal member 32.

The knob 30 is of a size so as to completely overlie the opening 26 within which the switching lever 22 is positioned. This knob, preferably of molded plastic, is to be configured so as to both provide an ornamental appearance and a surface configuration which, while enabling a relatively simple gripping and removal thereof by an adult, would present some difficulties to young children in particular. For example, the knob 30, as illustrated, can be provided with inclined upper and lower surfaces 34 tapering forwardly.

Figure 3:
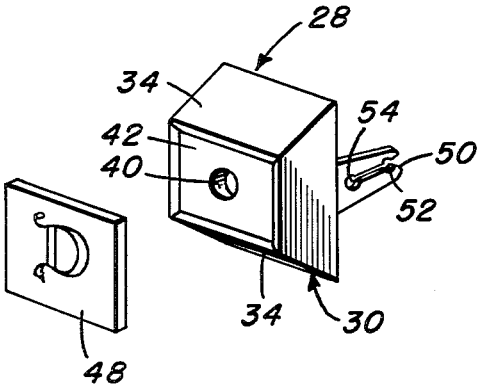
FIG. 3 is a front perspective view of the safety cover with the face plate exploded therefrom.
Figure 4:
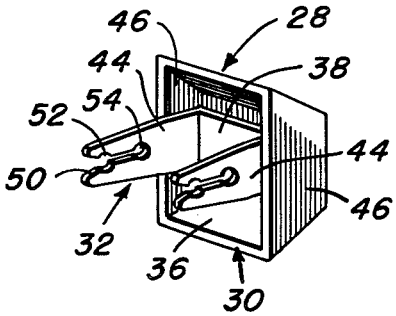
FIG. 4 is a rear perspective view of the safety cover.
Figure 5:
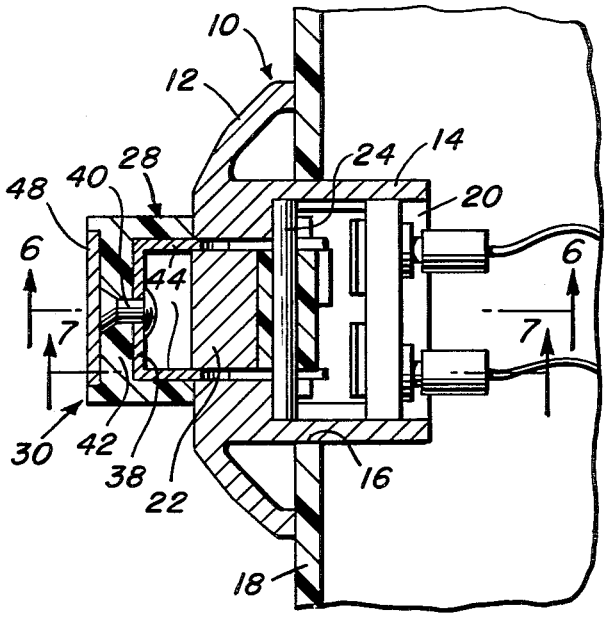
FIG. 5 is an enlarged cross-sectional view taken through the installed cover substantially along line 5—5 in FIG. 2.

The rear of the knob or cover member 30, will define an enlarged recess 36 which receives the bight portion 38 of the U-shaped spring member 32. This bight portion 38 will be appropriately affixed, as by rivet 40, to the inner face of the front wall 42 of the knob 30 with the rearwardly projecting legs 44 thereof being in parallel laterally spaced relation to each other and positioned against the inner faces of the opposed side walls 46 of the knob 30. The outer end or head of the rivet 40, as will be best appreciated from FIGS. 3 and 5, can be concealed by an appropriate decorative face plate 48 snapped into a recess provided in the front face of the forward wall 42 of the knob 30.

The opposed spring metal legs 44 project a substantial distance rearward of the rear of the knob 30 and are of a relatively wide flat configuration so as to slide easily between the opposed sides of the actuating lever 22 and the adjacent inner walls which define the opening 26. Each of these legs 44 is bifurcated and includes an enlarged open end 50 easily positioned in engagement with the lever mounting shaft 24. This enlarged open end 50 tapers inwardly to an annular enlargement 52 adapted to receive and snugly conform to the shaft 24. Thus, in mounting the cover, the wide mouths 50 of the bifurcated legs 44 are engaged with the shaft 24 and the cover, and hence the legs 44, pushed inwardly so as to cause a flexing of the bifurcated legs and a snap positioning of the shaft within the circular enlargements 52 of the legs. In order to ensure sufficient resiliency within the bifurcated legs 44, the bifurcation defining slots will extend inwardly from the shaft receiving recesses 52 and terminate in inwardly located circular ends 54.

In removing the safety cover 28, the cover, or more particularly the knob 30, will be pulled outward, causing a disengagement of the bifurcated legs 44 from the shaft 24. It is contemplated that the effort required for disengagement will be slightly greater than that required to engage the cover.

Figure 2:
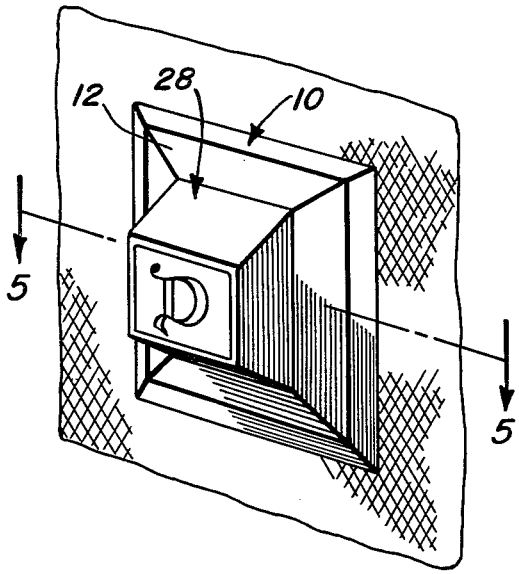
FIG. 2 is a perspective view of the power window control with the safety cover of the present invention mounted thereon.
Figure 6:
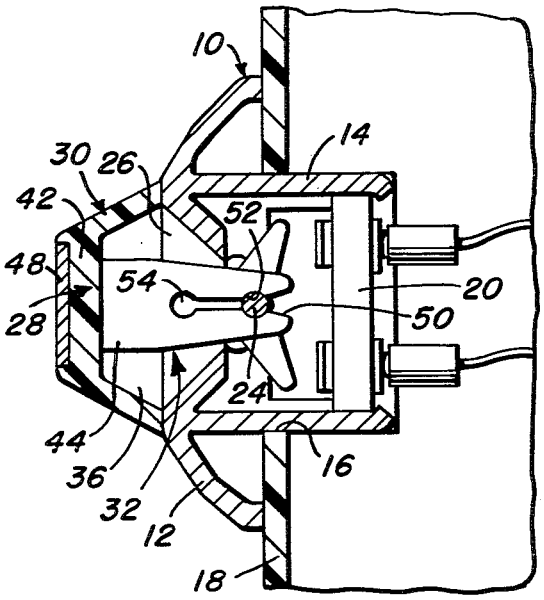
FIG. 6 is a vertical cross-sectional view taken substantially in a plane passing along line 6—6 in FIG. 5.
Figure 7:
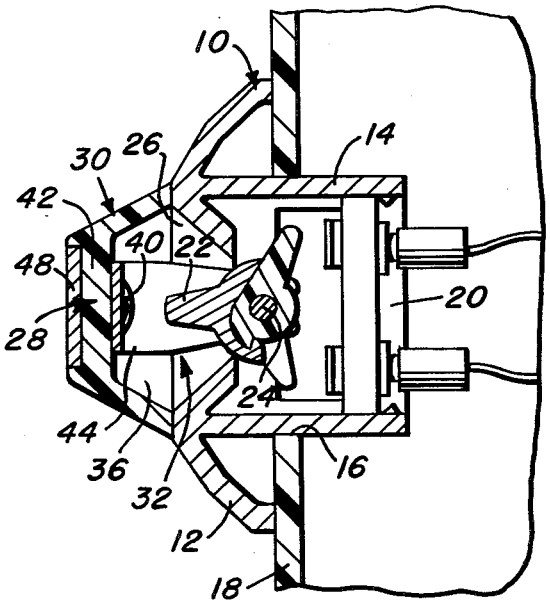
FIG. 7 is a vertical cross-sectional view taken substantially in a plane passing along line 7—7 in FIG. 5.

As will be appreciated from the drawings and in particular FIGS. 2, 6 and 7, the cover 28, when mounted, completely covers and conceals the actuating lever 22. This in turn precludes any possibility of the lever being manipulated. The particular size of the knob 30, as well as the lengths of the mounting legs 44, will be such so as to accommodate the specific control with which they are to be associated. It is preferred that the rear of the knob 30, as will be noted in FIGS. 5, 6 and 7, seat directly on the front of the escutcheon or housing as the lever shaft 24 is engaged within the shaft accommodating recesses 52 within the bifurcated legs 44.

While not specifically illustrated, the present invention also contemplates the construction of the safety cover as an integral unit. For example, the bifurcated mounting legs can be formed of the same material as the knob, either metal or plastic, while still providing the desired resiliency so as to achieve the snap-locking to the lever shaft.

The foregoing is considered illustrative of the principles of the invention. Since modifications and changes may occur to those skilled in the art, it is to be appreciated that it is not desired to limit the invention to the exact construction shown and described, and thus, all modifications and equivalents, falling within the scope of the invention as claimed, are considered to be encompassed by the invention.

I claim:

1. For use with a shaft mounted power actuating lever projecting outward from the interior paneling of a vehicle, a safety cover for precluding operating access to the shaft mounted power actuating lever, said cover including a knob adapted to overlie the lever, said knob having a lever receiving recess defined therein and an edge about said recess engageable with the paneling about the lever to completely enclose the lever, and mounting leg means fixed to said knob and projecting rearwardly therefrom for positioning along and in closely spaced relation adjacent the lever, said leg means including a shaft engaging configuration and being adapted to snap-lock to the lever mounting shaft in conjunction with an engagement of the knob edge with the paneling for a retention of the knob as a cover means over said actuating lever.

2. The safety cover of claim 1 wherein said leg means includes a pair of laterally spaced parallel legs positionable adjacent a pair of opposed sides of the lever, said legs being fixed to and projecting rearwrdly from said knob inward of the edge about said recess.

3. The safety cover of claim 2 wherein said legs are formed of a spring material, each of said legs having an outer bifurcated end with a shaft accommodating recess formed therein.

4. The safety cover of claim 3 wherein said legs include inner ends interconnected by an integral bight portion, and means fixing said bight portion to said knob within said recess.

5. The safety cover of claim 4 wherein said knob includes at least one pair of opposed inclined sides providing a forwardly tapered configuration.

6. In a control assembly for a vehicle door lock or power window, housing means including and open front end. a shaft mounted across said housing means inward of said front end, an actuating lever pivotally mounted on said shaft and accessible through said open front end, and a safety cover completely enclosing and preventing operating access to said actuating lever, said safety cover comprising a cover member engaging said housing means about said open front end and overlying said open front end of said housing means and the lever in outwardly spaced relation to said lever, said safety cover further comprising mounting leg means fixed to said cover member and projecting rearwardly therefrom through said open front end laterally of said lever, wherein said leg means includes means for releasable mounted engagement with said shaft for a releasable retention of said cover member over said open front end and said lever, and in engagement with said housing means.

7. The control assembly of claim 6 wherein said leg means comprises a pair of laterally spaced legs received through said open front end to the opposite sides of said actuating lever, each of said legs including means on the inner end thereof releasably engaging said shaft.

8. The control assembly of claim 7 wherein the means on the inner end of each leg is defined by a bifurcation including a shaft accommodating recess defined therein.

* * * * *